US005138538A

United States Patent [19]

Sperling

[11] Patent Number: 5,138,538

[45] Date of Patent: Aug. 11, 1992

[54] SELF-EXTINGUISHING FLASHLIGHT

[76] Inventor: Michael Z. Sperling, 53 Sealy Dr., Lawrence, N.Y. 11559

[21] Appl. No.: 674,092

[22] Filed: Mar. 25, 1991

[51] Int. Cl.[5] ..... F21L 7/00

[52] U.S. Cl. ..... 362/205; 362/295; 362/394; 362/802; 315/360; 200/60

[58] Field of Search ..... 362/205, 208, 295, 394, 362/802; 446/485; 315/74, 76, 360; 200/60

[56] References Cited

U.S. PATENT DOCUMENTS 3,535,282 10/1970 Mallory ..... 200/60
3,564,761 2/1971 Bear et al. ..... 200/60
4,464,861 8/1984 Fogarty et al. ..... 446/485
4,623,957 11/1986 Moore et al. ..... 362/191
4,875,147 10/1989 Auer ..... 362/202
4,985,813 1/1991 Putman ..... 362/295

*Primary Examiner*—Ira S. Lazarus
*Assistant Examiner*—Y. Quach
*Attorney, Agent, or Firm*—Ronald Abramson

[57] ABSTRACT

A flashlight having a self-extingushing feature that prevents unintentional run-down of its batteries, particularly when used by children, which is achieved by means of a circuit breaking device controlled by a timer, and further having a bypass switch, preferably of a child-proof nature, to override the self-extinguishing feature and thereby improve the utility of such flashlight as an ordinary household flashlight. Optionally, the flalshlight may also have additional "child-proofing" mechanisms such as an interlock to prevent unintended activation of the bypass switch.

15 Claims, 3 Drawing Sheets

SELF-EXTINGUISHING FLASHLIGHT

BACKGROUND OF THE INVENTION

This invention relates to hand-held light sources, and more particularly to flashlights having means to turn themselves off after a predetermined interval, particularly when used by children. It further relates to the incorporation in general purpose household flashlights of bypass and "child-proofing" mechanisms such that if such flashlights are played with by children their batteries will not be completely drained, but will retain power for service in emergencies. Furthermore, the bypass mechanism can be used to ensure that the flashlight will not turn itself off during an emergency or other situation in which uninterrupted service is desired.

Hand-held light sources have been used in one form or another for millennia. Ancient legend recounts Diogenes' fruitless search for an honest man as having been conducted with the unaviling aid of a hand-lantern. Prehistoric light sources were doubtless torches, but the invention of the oil lamp made possible the hand-lantern, its wick sheltered in a wind-proof housing. At a later stage, candles supplanted the oil lamp, only themselves to yield to kerosene lamps in the late 19th century. Carbide lamps, in turn, supplanted those in such applications as mining, until modern times, when the perfection of durable dry cells made what the English call the electric torch, and what is known in America as the flashlight, a practical alternative.

Until the invention of the flashlight, all hand-lanterns employed a flame and a reservoir of flammable material, whether liquid or solid. Such lanterns were capable of igniting a conflagration in the home, the barn or the workplace, and were therefore reserved exclusively for use by adults, since no child could be trusted to handle one safely. However, the advent of the flashlight eliminated that danger, and while flashlights retain their essential role of safe and convenient portable light sources, they have become widely available to children as toys.

No parent will permit a child to play with matches or candles, but most will indulgently permit their children to use their bedsheets as a tent, and to pretend to "camp out" on their beds, reading their favorite book by the light of a flashlight. Of course, the children are soon fast asleep, but when parents tiptoe in to tuck them in for the night, the flashlight buried in the bedclothes is often forgotten, and by morning its batteries are fully discharged.

Similarly, when children are sent off to summer camp with the obligatory flashlight, its batteries are typically discharged during the first evening hike or campfire entertainment. All children are adept at switching on a flashlight, but none seems capable of switching one off.

Since most modern batteries are leakproof and will not ruin a flashlight by leaking when fully discharged, it might be imagined that the cost of replacing batteries is the only consequence of such unintended discharge. However, the more serious problem is the fact that in a household with children even flashlights reserved for emergency use are subject to the same fate. A flashlight is as irresistible to a child as the proverbial flame is to a moth. Every flashlight within reach is used as a toy, and no shelf is high enough, nor any hiding place secret enough to keep a flashlight from a child's reach. When, in an emergency, a parent tries to switch one on, its failure to respond with even a dim glow testifies to the child's diligence in searching out the irresistible plaything.

As noted earlier, the central problem is to get the flashlight swithched off. A child's attention span is short, so the play centered on the flashlight is soon replaced by another game or interest, while the flashlight is abandoned to discharge its batteries unnoticed.

Ordinary flashlights have addressed some of these concerns in a limited manner by often including a button that can be pressed in lieu of turning on the main power switch in order to turn the light on momentarily. Primarily, this added element was intended to permit on-off or Morse-code signaling or flashing—an early feature that gave rise to the appellation "flashlight-"—rather than as a means to conserve batteries. Other, small, flashlights have been sold which included switches whose contacts are closed when the barrel of the flashlight is squeezed. None of such mechanisms, of course, will by themselves keep the flashlight lit after they are let go of, and hence their utility for the purposes discussed herein is limited.

Various methods of providing a flashlight with a delayed means of deactivation are also known in the art. These address more directly the concerns noted above, although each such prior art device has distinct disadvantages. Mallory, in U.S. Pat. No. 3,535,282, disclosed a flashlight in which means, such as a spring and bellows arrangement utilizing a controlled air leak to control decompression of the spring, were employed to open the power switch in a flashlight after a predetermined interval. Auer, in U.S. Pat. No. 4,875,147 disclosed a flashlight that employed a suction cup as a delayed action element to control the release of a power switch. An electronic means for obtaining a delayed action is employed in toy flashlights sold by Playskool, Inc. and by Fisher-Price Toys. The Playskool flashlight uses a resistor-capacitor timing circuit to apply a bias to a solid-state switching element in order to shut off the flashlight after about a 30-second interval following a child's release of a handle containing a spring-loaded on-off switch. The Fisher-Price flashlight uses an electronic timing circuit simply to turn off the flashlight after about 20 minutes.

It is observed that the above-mentioned delayed-action prior art devices provide no means for overriding the self-extinguishing mechanism in order to enable unattended use for extended periods when so desired. In the ordinary household use of a flashlight it is sometimes necessary to be able to have the light remain on for an extended period without having to hold or keep reactivating the flashlight. The absence of such a capability prevents such prior art devices from fully meeting the requirements of a general-purpose household flashlight.

In addition, the devices disclosed by Auer and Mallory operate by turning off the main power switch itself, which tends to limit the available delayed action devices to bulky and relatively complicated mechanical structures. Furthermore, the device sold by Playskool employs a solid-state switch which entails a drop of approximately one-half volt across a semiconductor junction, noticeably reducing the brightness of the flashlight.

SUMMARY OF THE INVENTION

It is an object of the present invention to provide a more simple and effective means than those known in the art for switching off a flashlight after a preset interval has elapsed, in order to prevent unintentional discharge of its batteries, particularly when used by children. A further object is to provide a convenient means of overriding the automatic switch-off function, when lengthy, uninterrupted service is desired. It is yet a further object of the invention to provide the foregoing functions in a manner such that the desired operational characteristics cannot easily be evaded by children. Other objects and advantages of the invention will become apparent upon reference to the figures.

Briefly stated, these objects are attained in a flashlight having the usual components of a battery, an on-off switch, a bulb and a hand-held housing, to which there is added a timing means and a circuit-breaking means responsive to the timing means for cutting off the flow of current to the bulb, and which further has a bypass means, preferably child-proof, to direct electric current to the light bulb regardless of the state of the timing means. The operation of such device may be further enhanced by making the bypass means a switch connected so as to leave it in series with the on-off switch. Furthermore, an interlock or other "child-proofing" mechanism may be provided to ensure that the bypass is disabled when the flashlight is switched off.

DETAILED DESCRIPTION OF THE INVENTION

Figure 1A:
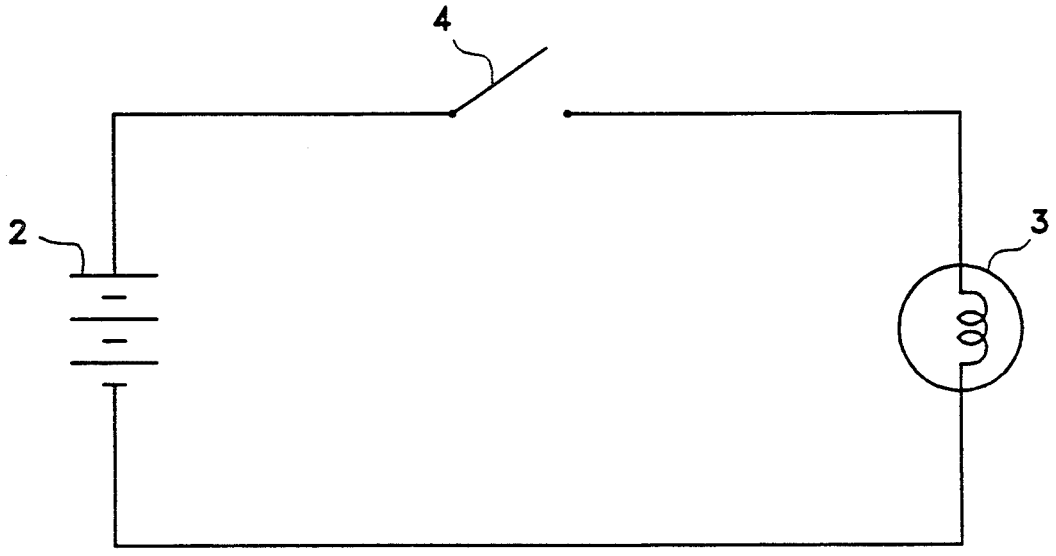
PRIOR ART Fig. 1A
FIG. 1*a* shows a functional schematic diagram of an ordinary flashlight.

The present invention is a form of flashlight that augments the ordinary flashlight, depicted schematically in FIG. 1*a*, with additional functionality. The present invention is readily understood upon reference to FIG. 1*b*, which shows one embodiment of the present invention. That embodiment, comprises an ordinary flashlight to which have been added a timer, a circuit-breaking device and a bypass switch. An ordinary flashlight, as shown in FIG. 1*a*, comprises a battery of dry cells (2) connected to a light bulb (3) through an on-off switch (4). As mentioned above, such flashlights often include an additional switch, not shown here, which is a contact switch in parallel with the on-off switch, that is provided for flashing or signalling by momentarily turning on and off the electric current.

Figure 1B:
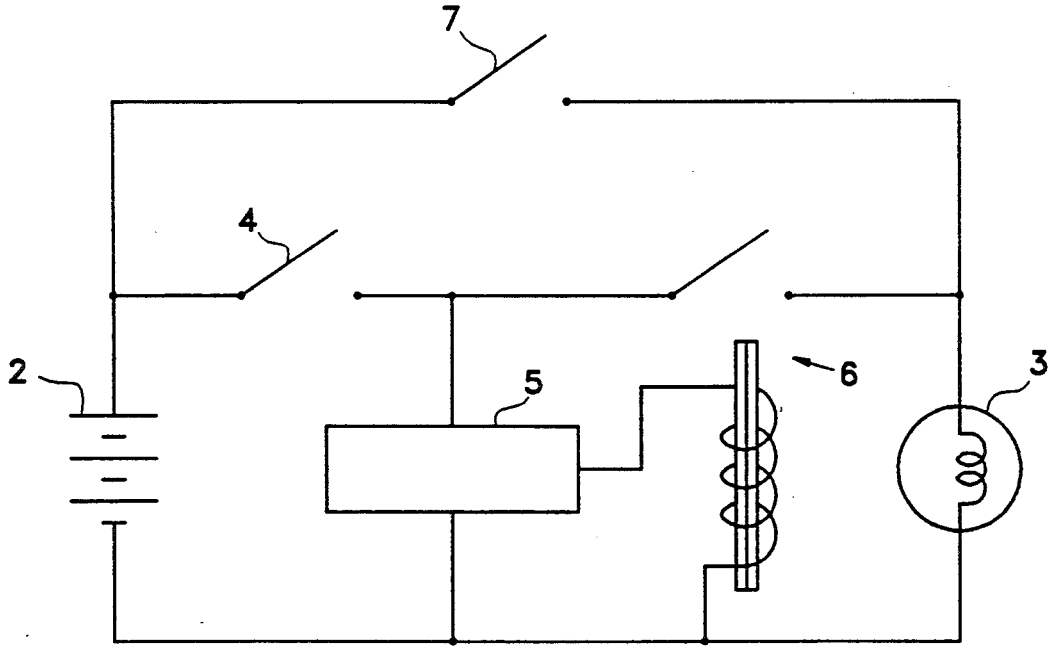
FIG. 1*b* shows a functional schematic diagram in which a flashlight incorporates a timer circuit, and in which a bypass switch is in parallel with and serves to bypass both the flashlight's on-off switch and the timer circuit.

Note in FIG. 1*b* the addition of a timer (5) to control a circuit-breaking device (6), to automatically disconnect the light bulb from the circuit after a preset interval. Note that a bypass switch (7) provides an alternative path for current to the light bulb, and thus can be used to override the automatic switching off function. Bypass switch (7) would typically be used by an adult who wanted to prevent interruption of the light by the time switching off function, and would preferably be "child-proofed." Such child-proofing might be attained by concealing bypass switch (7) in the flashlight base (9) or elsewhere in the flashlight, or by leaving it in plain sight but restricting its movement by inexpensive means (10) requiring particular muscle coordination and strength in order to be operated, such as the closure of a medicine container (10).

In ordinary operation, closing the on-off switch does two things: it resets timer (5) to zero and restarts it; and it powers circuit breaker (6), closing it to complete the circuit from battery (2) to light bulb (3). The timer may comprise any number of devices, including a digital clock, a resistor-capacitor timer, etc. Circuit-breaker (6), here illustratively shown as electromechanical, may also be one of several types of devices, including a solid-state switch. While an electromechanical device may draw a significant percentage of the battery's load, it can easily switch current to the light bulb, that can be on the order of one ampere, without imposing the forward voltage drop of a suitable solid-state device, typically one-half volt. When the predetermined timer interval has elapsed, timer (5) switches open circuit-breaker device (6), switching off the light and removing from the battery the additional load of circuit-breaker device (6). At this point, the only load on the battery is the negligible one comprised of the high-impedance input to the timer (5). That load can be designed to draw less current than the internal, self-discharge leakage current of the battery, and may therefore be ignored.

To relight the flashlight, battery (2) is briefly disconnected from timer (5) to reset the timer, and battery (2) is then reconnected to start the timing cycle again and to close circuit-breaker (6). This can be accomplished by switching the on-off switch (4) first off and then promptly on again. If the timer is based on the charging rate of a capacitor, for example in a resistor-capacitor charging circuit, it may be most convenient to discharge the capacitor through an additional pole on the on-off switch.

Note that in this embodiment bypass switch (7) bypasses both the timer (5) and the on-off switch (4). A clever child who might manage to operate bypass switch (7) might also notice that when that switch was used instead of the on-off switch, the flashlight would remain lit, rather than going off after a while. That awareness might lead such a child to use the bypass switch in preference to the on-off switch, vitiating the intended function of the timer.

Figure 2:
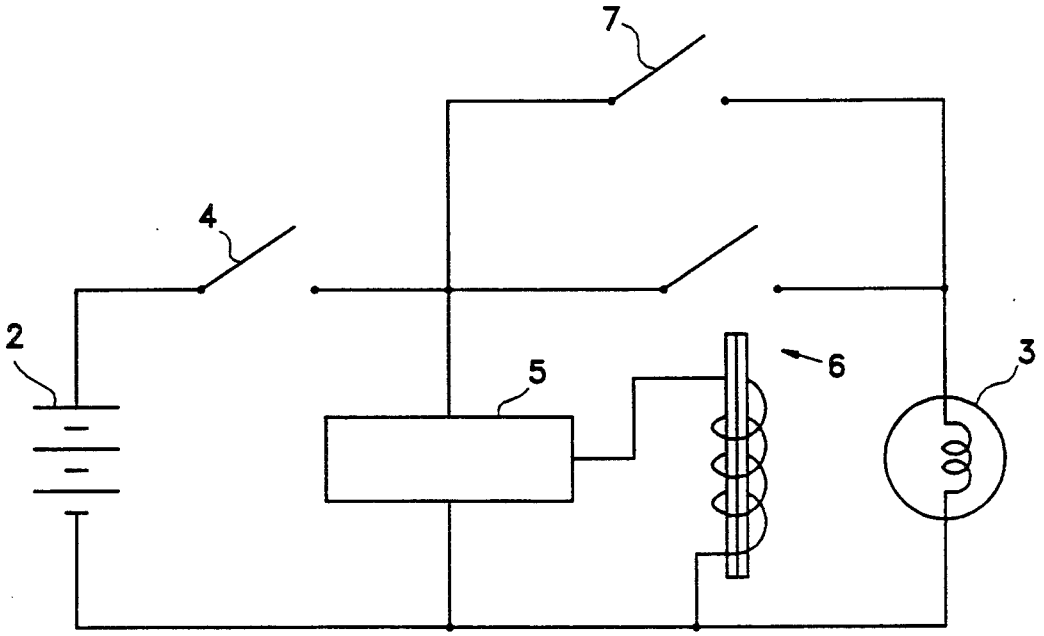
FIG. 2 shows an embodiment in which the bypass switch is in parallel with the timer circuit, but in series with the on-off switch.

This possibility is prevented by the embodiment of FIG. 2, in which bypass switch (7) only bypasses the timer and the circuit-breaker it controls. Therefore, if a child should manage to switch on the bypass switch, the flashlight will not light unless the on-off switch is also switched on. Similarly, if the child should manage to switch off the bypass switch while the flashlight is lit, he will find that it has no effect, since the light will remain on. The child who experiments with these two switches will conclude that the bypass switch has no effect on the light, and will ignore that switch in the future, assuring the timer function the proper control of the flashlight.

In all other respects, this embodiment would function like that of FIG. 1*b*.

Figure 3:
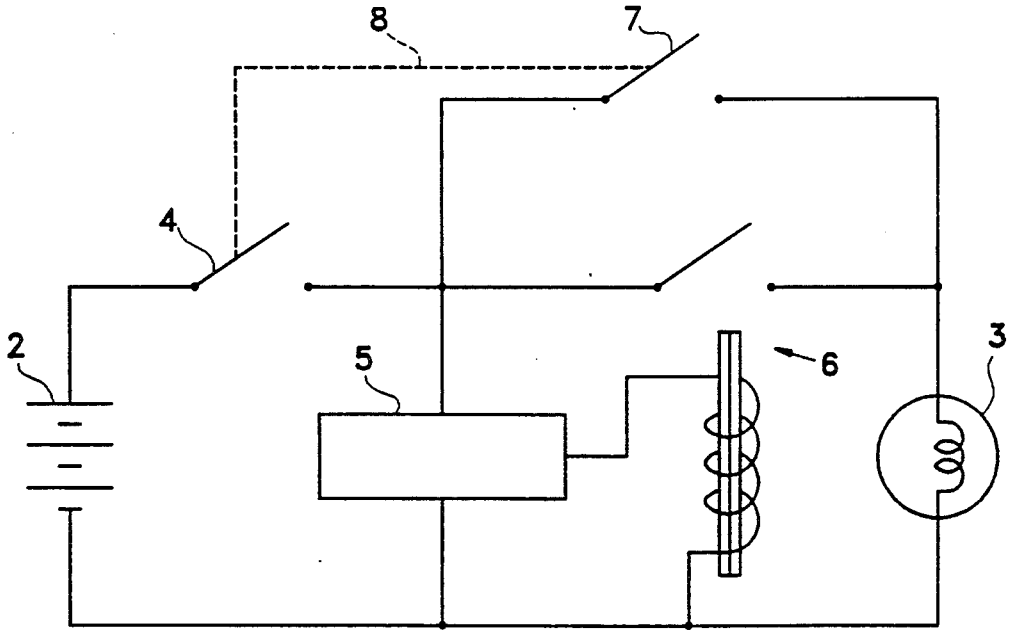
FIG. 3 shows an alternative embodiment based on that of FIG. 2, but in which an interlock arrangement is added between the on-off switch and the bypass switch.
Figure 4:
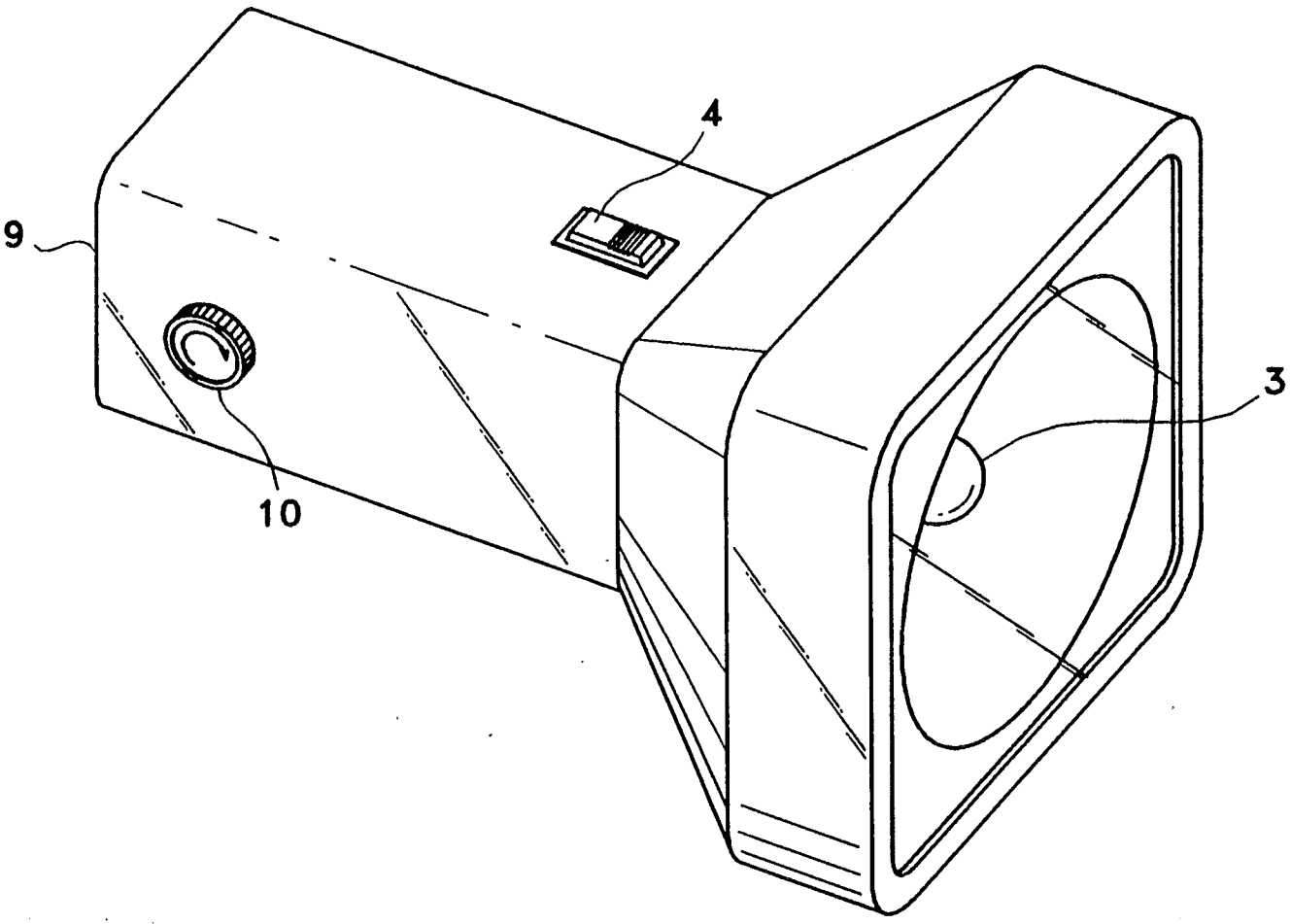
FIG. 4 shows a flashlight contained in a housing and constructed in accordance with the circuit of either FIG. 1*b* or FIG. 2, on which can be seen the on-off switch (4) and the light bulb (3) of FIGS. 1*b* and 2, and a means (10) of restricting the movement of the bypass switch (4) of FIGS. 1*b* and 2. (The bypass switch itself is not visible in FIG. 4 because it is situated under the movement restricting means).

FIG. 3 illustrates a variant of the arrangement shown in FIG. 2. Here, an interlock (8) is added to link on-off switch (4) and bypass switch (7), so bypass switch (7) cannot inadvertently be left in its closed position when the flashlight is switched on after use. When the on-off switch (4) is switched off, interlock (8) also switches bypass switch (7) to an open position. This is the only situation in which the interlock has an effect. Thus, when the flashlight is next switched on, bypass switch (7) must be deliberately switched on, if so desired, and cannot simply be left on from its last use.

The embodiments described above clearly realize the stated objects of the invention, yet are not intended as an exhaustive compilation of the invention's content of patentable novelty. Numerous further variants will be obvious and may be effected by anyone skilled in the art without departing from the scope or spirit of the invention. For example: the timer may be a mechanical device such as a dashpot and spring arrangement; the timer interval may be made adjustable, either through analog or digital means, to match the attention spans of younger or older children; to aid in resetting the timer, the on-off switch may be of the double-pole, single-throw (DPST) variety, rather than the single-pole, single-throw type shown in the figures, etc.

I claim:

1. A self-extinguishing flashlight, comprising a battery;

an on-off switch for controlling the flow of current from the battery;

a timer means which changes state when a preset interval has elapsed;

a circuit-breaking means connected in series with the on-off switch and the battery having two controlled terminals and a control input, wherein the control input is responsive to the state of the timer means and electrical conductivity between two controlled terminals is controlled by the aforementioned control input;

a light bulb in series with the on-off switch, the circuit breaking means and the battery, so as to complete an electrical circuit when the circuit breaking means and the on-off switch are in a conductive state;

a bypass means connected in parallel across the controlled terminals of the circuit breaking means; and a hand-held housing having a base at one end, to accommodate and position said battery, on-off switch, timer means, circuit-breaking means, light bulb and bypass means such that the on-off switch is accessible by hand and that light may be directed from the light bulb away from the flashlight.

2. The self-extinguishing flashlight of claim 1, further comprising an interlock means adapted such that switching off the on-off switch also forces the bypass switch to an open position.

3. The self-extinguishing flashlight of claim 4, in which the timer means is an electrically operated device.

4. The self-extinguishing flashlight of claim 3, in which the on-off switch contains a separate pole for resetting the timer means to a state representing zero elapsed time.

5. The self-extinguishing flashlight of claim 4, in which the delayed action of the timer means is adjustable.

6. The self-extinguishing flashlight of claim 5, in which the bypass means has been adapted to be child-proof, by means selected from a group consisting of concealment in the base of the hand-held housing, concealment elsewhere in the hand-held housing, or restricting the movement of the bypass means with a device that must be moved in order to activate the bypass means, which device requires particular muscle coordination and strength in order to be moved.

7. The self-extinguishing flashlight of claim 3, in which the delayed action of the timer means is adjustable.

8. The apparatus of claim 7, in which the bypass means has been adapted to be child-proof, by means selected from a group consisting of concealment in the base of the hand-held housing, concealment elsewhere in the hand-held housing, or restricting the movement of the bypass means with a device that must be moved in order to activate the bypass means, which device requires particular muscle, coordination and strength in order to be moved.

9. The self-extinguishing flashlight of claim 2, in which the delayed action of the timer means is adjustable.

10. The apparatus of claim 4, in which the bypass means has been adapted to be child-proof, by means selected from a group consisting of concealment in the base of the hand-held housing, concealment elsewhere in the hand-held housing, or restricting the movement of the bypass means with a device that must be moved in order to activate the bypass means, which device requires particular muscle coordination and strength in order to be moved.

11. The self-extinguishing flashlight of claim 1, in which the timer means is an electrically operated device.

12. The self-extinguishing flashlight of claim 11, in which the on-off switch contains a separate pole for resetting the timer means to a state representing zero elapsed time.

13. The self-extinguishing flashlight of claim 1, in which the delayed action of the timer means is adjustable.

14. The self-extinguishing flashlight of claim 1, in which the bypass means has been adapted to be child-proof, by means selected from a group consisting of concealment in the base of the hand-held housing, concealment elsewhere in the hand-held housing, or restricting the movement of the bypass means with a device that must be moved in order to activate the bypass means, which device requires particular muscle coordination and strength in order to be moved.

15. A self-extinguishing flashlight, comprising a hand-held housing having a base at one end;

a battery;

an on-off switch positioned in the housing so as to be accessible by hand, for controlling the flow of current from the battery;

a timer means which changes state when a preset interval has elapsed;

a circuit-breaking means connected in series with the on-off switch and the battery having a control input responsive to the state of the timer means;

a light bulb in series with the on-off switch, the circuit breaking means and the battery, and positioned in the housing so as to direct light away therefrom; and a bypass switch connected directly from the battery to the light bulb, which bypass switch has been adapted to be child-proof, by means selected from a group consisting of concealment in the base of the hand-held housing, concealment elsewhere in the hand-held housing, or restricting the movement of the bypass switch with a device that must be moved in order to activate the bypass switch, which device requires particular muscle coordination and strength in order to be moved.

* * * * *

UNITED STATES PATENT AND TRADEMARK OFFICE

CERTIFICATE OF CORRECTION

PATENT NO. : 5,138,538

DATED : August 11, 1992

INVENTOR(S) : Michael Z. Sperling

It is certified that error appears in the above-identified patent and that said Letters Patent is hereby corrected as shown below:

On the title page:

In the abstract, 9th line, "flalshlight" should read --flashlight--.

Column 1, at line 20, "unaviling" should read --unavailing--.

Column 2, at line 4, "swithched" should read --switched--; at line 14, following the word "flashlight" delete the dash and insert a closing quotation mark --"--; and at line 15, delete the closing quotation mark at the beginning of the line.

Column 4, at line 7, "time" should read --timed--; and at line 14, delete the drawing reference numeral "(10)" at the end of the sentence.

Column 5, at line 39, "between two" should read --between the two--.

In claim 3, at Column 5, line 59, the claim reference numeral "4" should read --2--.

In claim 8, at Column 6, line 13, "apparatus" should read --self-extinguishing flashlight--; and at line 20, delete the comma following the word "muscle".

UNITED STATES PATENT AND TRADEMARK OFFICE

CERTIFICATE OF CORRECTION

PATENT NO. : 5,138,538

DATED : August 11, 1992

INVENTOR(S) : Michael Z. Sperling

It is certified that error appears in the above-indentified patent and that said Letters Patent is hereby corrected as shown below:

In Claim 10, at column 6, line 25, "apparatus" should read —self-extinguishing flashlight— and the claim reference numeral "4" should read —2—.

Signed and Sealed this

Twelfth Day of October, 1993

*Attest:*

Bruce Lehman

BRUCE LEHMAN

*Attesting Officer*

*Commissioner of Patents and Trademarks*